United States Patent [19]

Face, III

[11] Patent Number: 4,875,802

[45] Date of Patent: Oct. 24, 1989

[54] INSTALLATIONAL CONCRETE JOINT INSERT AND METHOD OF PREVENTING EDGE SPALLING

[75] Inventor: Samuel A. Face, III, Newport News, Va.

[73] Assignee: The Edward W. Face Co., Inc., Norfolk, Va.

[21] Appl. No.: 241,420

[22] Filed: Sep. 7, 1988

[51] Int. Cl.[4] ..... E01C 11/08

[52] U.S. Cl. ..... 404/67; 404/65

[58] Field of Search ..... 404/47, 64–69; 52/396, 403, 573; 14/16.5

[56] References Cited

U.S. PATENT DOCUMENTS

| | | | |
|---|---|---|---|
| 1,654,793 | 1/1928 | Cowen | 404/64 |
| 2,540,251 | 2/1951 | Fischer | 404/47 |
| 4,285,612 | 8/1981 | Betti | 52/396 X |
| 4,533,278 | 8/1985 | Corsover et al. | 52/396 X |
| 4,699,540 | 10/1987 | Gibbon et al. | 404/67 X |

FOREIGN PATENT DOCUMENTS

| | | | |
|---|---|---|---|
| 678685 | 1/1964 | Canada | 52/403 |
| 790888 | 7/1968 | Canada | 404/65 |
| 0003720 | 8/1979 | European Pat. Off. | 404/64 |
| 2253140 | 12/1973 | Fed. Rep. of Germany | 404/64 |
| 2904236 | 8/1980 | Fed. Rep. of Germany | 52/396 |
| 2331650 | 6/1977 | France | 404/64 |

*Primary Examiner*—Stephen J. Novosad
*Assistant Examiner*—Gay Ann Spahn
*Attorney, Agent, or Firm*—Fleit, Jacobson, Cohn, Price, Holman & Stern

[57] ABSTRACT

Joint spaces within structural concrete bodies are filled with semi-rigid fillers to avoid adjacent concrete layer re-cracking and protect the concrete surface edges of the joint spaces against spalling by repeated impact loading. Inserts embedded in the fillers locationally restrict stress-induced fracture to the joint spaces and in spaced relation to the concrete bonding interfaces of the fillers so as to maintain filler protection for the concrete edges against spalling damage.

18 Claims, 3 Drawing Sheets

INSTALLATIONAL CONCRETE JOINT INSERT AND METHOD OF PREVENTING EDGE SPALLING

BACKGROUND OF THE INVENTION

This invention relates generally to joints in concrete slabs, and more particularly to an improved joint and method of installation to prevent concrete surface deterioration caused by spalling at edges of the joint spaces.

Concrete floor slabs having exposed surfaces subjected to repeated impact loads, such as those produced by hard wheel tires on industrial lift trucks, are susceptible to localized failure at unprotected edges of cracks and joint spaces because of the inherent brittleness and weakness of concrete in both tension and shear. The breakage and crushing type failure at the unprotected edges is generally referred to in the art as "spalling". To reduce the likelihood of edge spalling, joint spaces and cracks are routinely filled with sealant materials in an effort to avoid edge exposure. In today's market, various liquid plastics including epoxies, urethanes and polysulfides are available as joint fillers. Nevertheless, floor joints and cracks in concrete surfaces subjected to hard-wheeled traffic continue to eventually break down because of spalling, regardless of the joint or crack filler material utilized.

Concrete slab shrinkage is a well known ongoing process because of hydration and drying within the concrete mass, and is manifested by steady growth in the width of joint spaces and cracks. The filler material selected must therefore accommodate such long-term slab shrinkage by virtue of its elastic and adhesive bonding properties. While the stresses induced by slab shrinkage are resisted both in the body of certain rigid types of filler materials and at their bonding interfaces with the concrete, eventually the tensile strength of adjacent layers of concrete is exceeded to cause adjacent layer fracture or "re-cracking". Such re-cracking phenomenon creates the very same condition the filler was intended to prevent or repair, i.e., concrete edge exposure. In an attempt to avoid re-cracking failure resulting from induced stresses, a semi-rigid, low-adhesive type of filler material has been formulated, wherein the concrete bonding interfaces of the filler are adhesively weaker than the tensile strength of the filler or the concrete alone, so as to preclude re-cracking of the concrete in spaced adjacency to the filler, as aforementioned. However, filler separation or fracture at the concrete bonding interfaces then occurs in response to shrinkage induced stress resulting in edge exposure and spalling under repeated impact loading.

Various joint filler modifications other than changes in material formulation have been proposed in an effort to deal with the foregoing spalling problem, including the use of plastic divider strips in an enlarged spalling repair patch, or insert elements embedded in the filler during joint installation. For example, a filler body is held compressed by an insert element during joint installation, for subsequent expansion within the joint space according to U.S. Pat. Nos. 3,276,334 and 3,255,680 to Rhodes and Cooper et al, respectively. According to U.S. Pat. No. 4,699,540 to Gibbon, a preformed cylindrical insert is utilized to relieve any strain at the concrete bonding interfaces of the filler caused by concrete expansion. However, none of the foregoing joint filler modifications provides a completely reliable solution to the problem of eventual failure by spalling at filled joint spaces and cracks, related to the aforementioned re-cracking phenomenon caused by long term slab shrinkage.

SUMMARY OF THE INVENTION

In accordance with the present invention, the filler within a concrete crack or joint space has an insert embedded therein with means on one side thereof to enhance bonding to the filler material so as to establish a path along the other low adhesive side of the insert for separation from the filler in response to stress induced in the concrete by long-term shrinkage, for example. The adhesive strength of the bond between the insert and the filler is accordingly arranged to be less than that of the concrete bonding interfaces.

When installed, the insert has means for maintaining at least its low adhesive side spaced throughout from the side wall surfaces of the crack or joint space to be filled by the filler, in order to avoid any fracture or separation capable of weakening the concrete bonding interfaces of the filler and to ensure the maintenance of concrete edge protection by the filler against spalling. According to one embodiment, insert spacing from the concrete bonding interfaces is established by lateral projections from the insert contacting the concrete side walls of the joint space. In another embodiment, a narrow retention slot is initially cut to receive and hold the insert in position while the slot is partially widened to the joint space dimension.

Pursuant to the present invention, the aforementioned insert is embedded within the filler during establishment of the joint to prevent spalling of the concrete edges at such joint, as distinguished from repair treatment of spalling damage at an existing joint, involving enlargement of the joint space to remove the damaged surface portions of the concrete. As a result of the treatment provided by the present invention, the only separation or re-cracking occurring because of induced stress is located within the joint itself and in spaced relation to the concrete edges so that the filler edge protection remains intact.

BRIEF DESCRIPTION OF THE DRAWING FIGURES

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
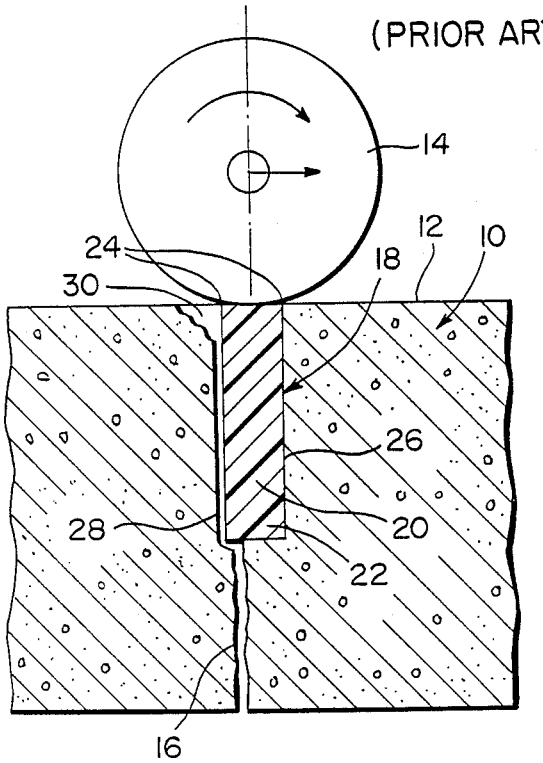
FIG. 1 (PRIOR ART)
FIG. 1 is a side section view through a concrete slab and expansion joint in accordance with a prior art arrangement, showing spalling damage under loading and stress-induced cracking conditions.

FIG. 1 illustrates by way of example a horizontal, concrete floor slab, generally referred to by reference numeral 10, having an upper exposed surface 12 to which moving impact loads are applied through a hard wheel 14 rolling over the surface. In an effort to pre-establish the location of all shrinkage induced fractures, such as the crack 16 shown in FIG. 1, narrow expansion joints were heretofore provided in the slab either during installation or by subsequent repair treatment, such as the expansion joint generally referred to by reference numeral 18. The expansion joint 18 is formed by a slot or joint space 20 in the concrete slab, cut to a predetermined depth and width and filled with a semi-rigid epoxy sealant material or laminant 22 in accordance with standard practice. The laminant or filler material 22 when fully cured exhibits a relatively high impact-resistant strength because of its resiliency, and completely fills the joint space so that its rigidity protects the surface edges 24 of the concrete at the intersections of the surface 12 with the side walls of the joint spaces. Low adhesive bonding interfaces 26 are formed between the filler 22 and the concrete side walls of the joint space so that re-cracking of adjacent layers of concrete is avoided. Such type of joint space filler is marketed as "MM-80 Semi-Rigid Epoxy Joint Filler" by the Metzger/McGuire Company of Concord, N.H.

The foregoing known type of expansion joint 18, while preventing stress-induced surface fracture between joints, is susceptible to adhesive rupture of the bonding interface at one side of the filler 22. Therefore, under impact loading of hard wheel traffic by wheels 14, for example, the concrete edge exposed at the surface 12 by separation or fracture 28 along one bonding interface, will rupture as shown by the spalled zone 30 in FIG. 1. If the filler material were made more adhesive and elastic to avoid fracture and separation at the bonding interface, it will not be sufficiently rigid to protect the concrete edges 24 from impact loads and spalling will also eventually occur.

Figure 2:
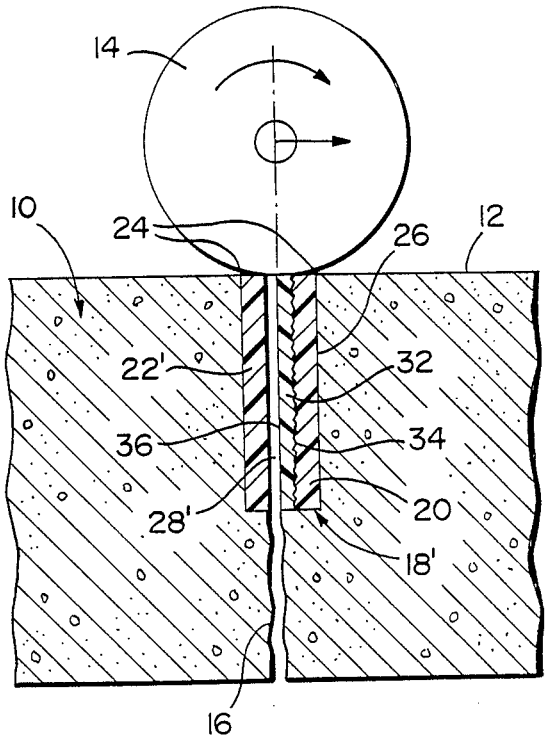
FIG. 2 is a side section view through a concrete slab showing an expansion joint in accordance with the present invention, under loading and stress-induced cracking conditions, similar to those shown in FIG. 1, but without spalling damage.

In order to avoid such spalling failure, the stress-induced surface fracture is relocated within the epoxy filler itself despite its high tensile strength, in accordance with the present invention. Thus, fracture 28' as an extension of the underlying crack 16 is spaced from both of the concrete bonding interfaces 26, as shown in FIG. 2 with respect to a modified form of expansion joint 18'. The expansion joint 18' is modified in accordance with the present invention by the provision of a plastic separation strip or insert 32 extending between the lower end surface and the upper exposed end surface of a filler 22' which may be made of the same material as described for filler 22 shown in FIG. 1, or may alternatively be made of a more rigid and more adhesive material. When installed, one side 34 of the insert is roughened to enhance bonding to the filler 22' leaving the other side 36 with an adhesive bond to the filler that is less than that of the concrete bonding interfaces 26, aforementioned. Fracture 28' along such lesser adhesive side 36 of the insert 32 thereby ensures that the concrete edges 24 remain protected by the filler 22' of joint 18', to prevent spalling.

Figure 3A:
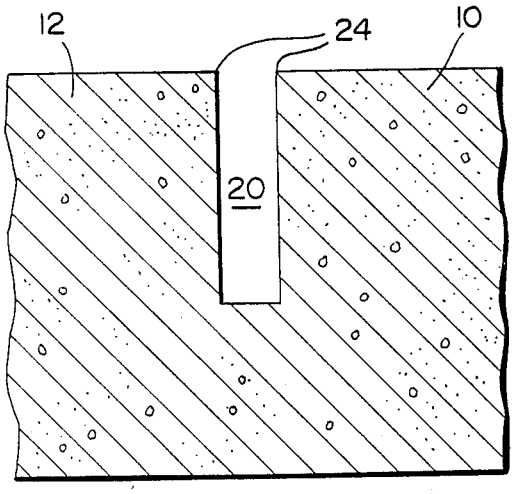
FIGS. 3A–3D are section views of a concrete slab showing different stages in the formation of the joint shown in FIG. 2.
Figure 3B:
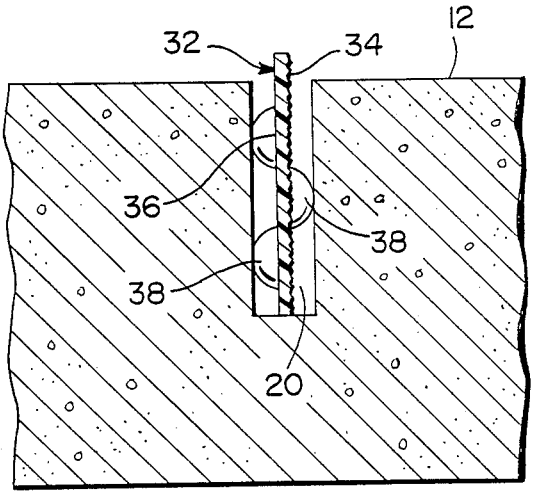
Figure 3C:
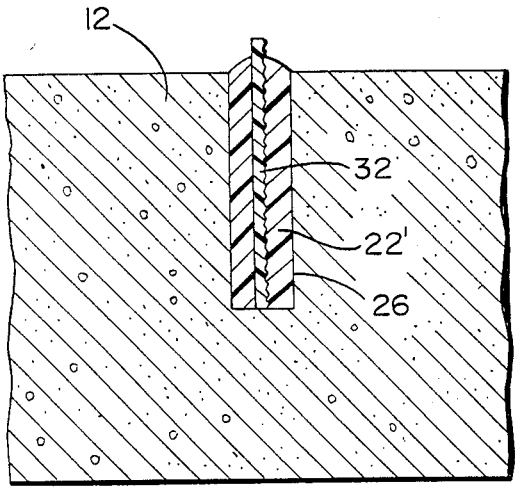
Figure 3D:
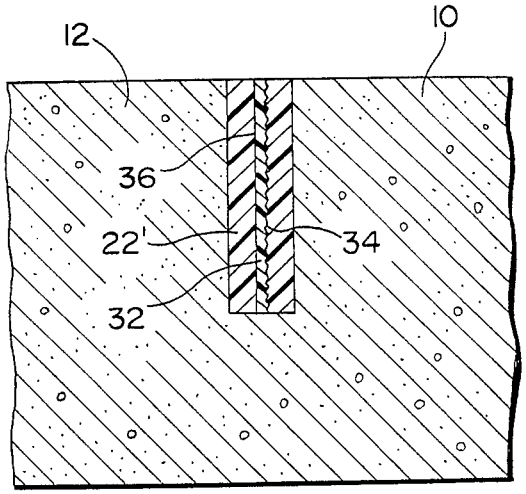

The joint 18' is formed during concrete slab installation, in accordance with the present invention, rather than as a repair treatment. As shown in FIG. 3A, the slab 10 has the joint space 20 cut therein, after which the insert 32 is positioned therein as shown in FIG. 3B. The filler 22' is then poured into the joint space and cured to its final state with the insert embedded therein, as shown in FIG. 3C. The insert 32 and filler 22' when installed project above the surface 12 as shown, and are subsequently cut flush with the surface 12 as shown in FIG. 3D. In actual practice, it may be convenient to reverse the order of insert and filler installation. That is, the filler 22' may first be poured into the joint space, with the insert 32 being pushed down into the joint while filler 22 is still liquid.

Figure 4:
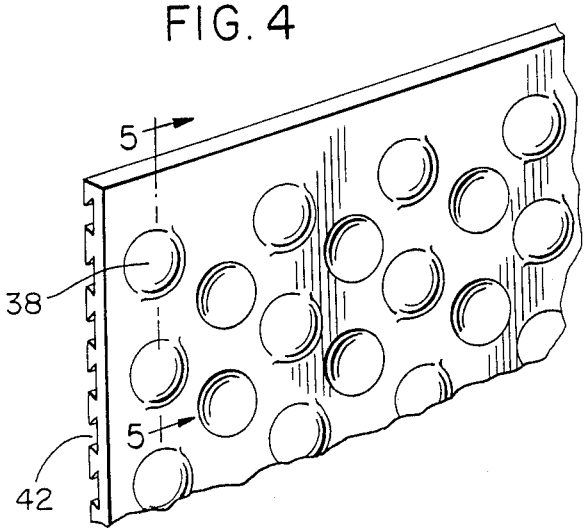
FIG. 4 is a partial perspective view of the insert to be embedded in the filler of the joint shown in FIGS. 2 and 3D, in accordance with one embodiment of the invention.
Figure 5:
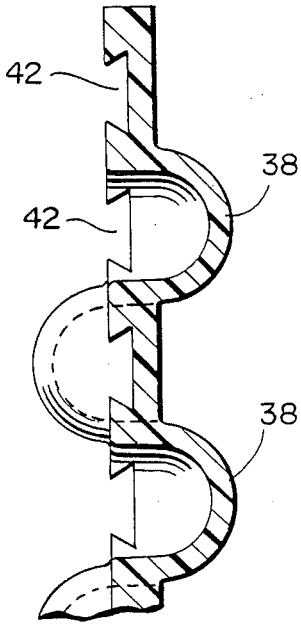
FIG. 5 is an enlarged partial section view taken substantially through a plane indicated by section line 5—5 in FIG. 4.

It is essential that the side surface 36 of the insert 32 be spaced throughout from the bonding interfaces 26 when the filler is installed. Toward that end, spacing projections or dimples 38 are formed on the insert and extend laterally therefrom for contact with the side walls of the joint slot 20 as more clearly seen in FIG. 3B, pursuant to one embodiment of the invention. The projections are spaced from each other and are non-aligned on opposite sides of the insert as shown in FIGS. 4 and 5 so as to accommodate free flow of the filler material in a fluent state when poured into the joint slot 20 during installation. In the particular embodiment of insert 32 shown in FIGS. 4 and 5, the insert body is made of polypropylene, with the dimple projections 38 struck out therefrom. The side surface 34 of the insert is roughened to enhance bonding by the formation of dovetail striations 42 therein.

Figure 7A:
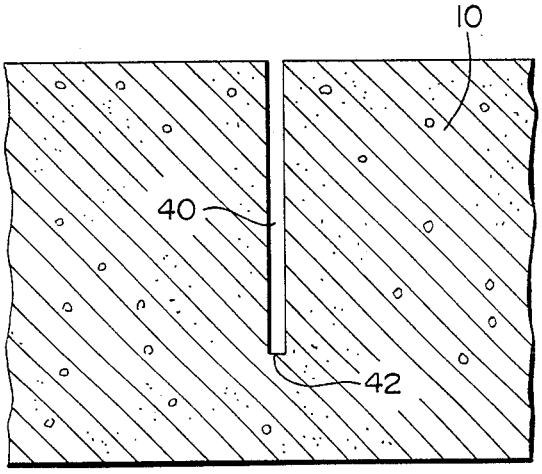
FIGS. 7A, 7B and 7C are side section views showing different stages in the formation of an expansion joint in a concrete slab, in accordance with another embodiment of the invention.
Figure 7B:
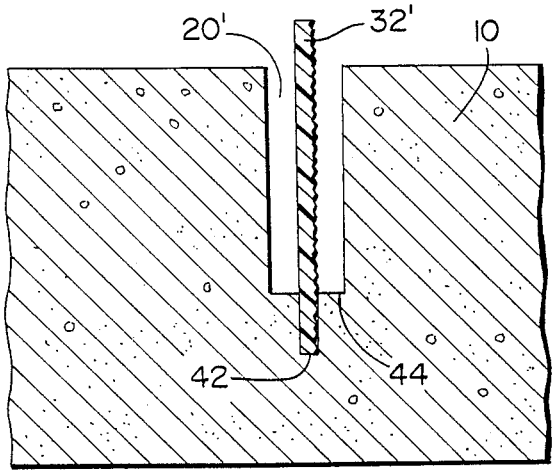
Figure 7C:
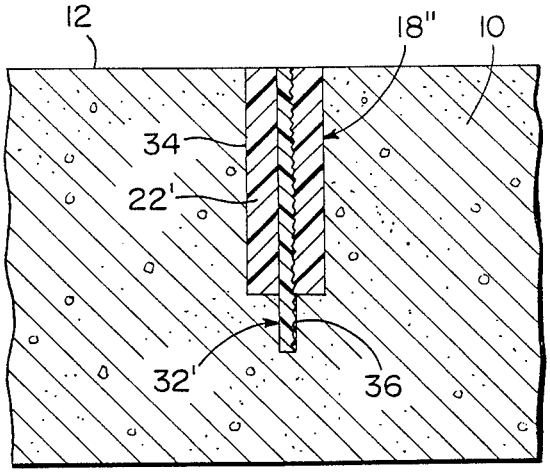

FIGS. 7A and 7B show another method of maintaining an insert 32' spaced throughout from the concrete bonding interfaces, without any lateral projections from the insert body. Initially, a narrow retention slot 40 is cut into the slab 10 to a depth 42 as shown in FIG. 7A, dimensioned to receive the insert 32'. The slot 40 is widened to a depth 44 above 42 to form the joint space 20', as shown in FIG. 7B. The filler is then installed within joint space 20' bonding to the concrete and the insert to complete the joint 18'', as shown in FIG. 7C, having the properties hereinbefore described with respect to FIGS. 2–5.

Figure 6:
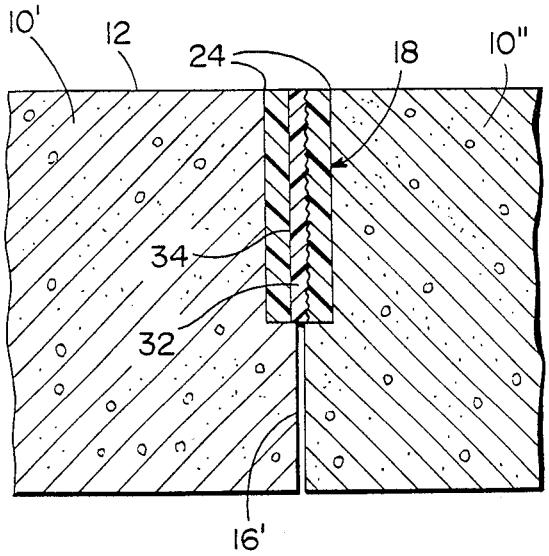
FIG. 6 is a side section view of the same joint shown in FIGS. 2 and 3D, installed between two abutting slabs.

The same joint 18' as hereinbefore described with respect to FIGS. 2–5, is shown installed between abutting concrete slabs 10' and 10'' in FIG. 6. The joint 18' will accordingly accommodate expansion or strain of the abutting slabs along gap 16', while protecting the concrete edges 24 against spalling by restricting formation of any fracture separation to the weaker adhesive side 34 of insert 32 as hereinbefore described.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows

1. A method of preventing spalling of a concrete surface at edges of bonding interfaces defining expansion spaces occupied by fillers having a tensile strength resisting formation therein of stress-induced cracks, the steps of: placing inserts into said expansion spaces extending from the concrete surface; spacing opposite sides of the inserts throughout from the bonding interfaces; and bonding the fillers during installation within the spaces at said bonding interfaces with greater adhesions than at said sides of each of the inserts; whereby the stress-induced cracks are directed during formation along said sides of the inserts in spaced relation to said edges at the concrete surface.

2. The method of claim 1 wherein said concrete surface is formed on a unitary concrete slab.

3. The method of claim 1 wherein said concrete surface is formed by at least two abutting concrete slabs and at least one of said spaces is an expansion joint slot formed between the abutting slabs.

4. The method of claim 1 including the step of roughening one of the sides of each of the inserts to enhance bonding thereat with the fillers.

5. The method of claim 1 including the step of forming dovetail striations in one of the sides of each of the inserts to enhance bonding thereat with the fillers.

6. The method of claim 1 wherein said step of spacing the inserts from the bonding interfaces includes: initially cutting retention slots narrower than the expansion spaces to a predetermined depth; positioning the inserts within said retention slots extending from the concrete surface to said predetermined depth; and laterally enlarging the retention slots to a depth above said predetermined depth of the retention slots to form the expansion spaces.

7. The method of claim 6 wherein said concrete surface is formed on a unitary concrete slab.

8. In an expansion joint for a concrete structure having a load bearing surface subject to impact loads, including an elongated slot formed in said surface to a predetermined depth creating spaced edges at said surface, a filler within said slot having a tensile strength resisting stress-induced fracture, said filler being bonded to the concrete structure within the slot at bonding interfaces terminating at said edges, an insert embedded in the filler having opposite side surfaces extending from the load bearing surface and means enhancing said bonding between the filler and the insert at one of the opposite side surfaces thereon for directing the stress-induced fracture along the other of the side surfaces of the insert.

9. The improvement as defined in claim 8 further including spacing means for ensuring that said other of the side surfaces of the insert is spaced throughout from the bonding interfaces.

10. In a joint for a concrete structure having a load bearing surface, including a slot formed in said surface to a predetermined depth creating spaced edges at said surface, a filler within said slot having a tensile strength resisting stress-induced fracture, said filler being bonded to the concrete structure within the slot at bonding interfaces terminating at said edges, and an insert embedded in the filler having opposite side surfaces extending from the load bearing surface to which the filler is bonded, the improvement comprising means on at least one of the opposite side surfaces of the insert for enhancing said bonding thereof to the filler and spacing means for ensuring that the side surfaces of the inserts are spaced throughout from the bonding interfaces, said spacing means including retention means extending below the slot for holding the insert within the slot in spaced relation to the bonding interface.

11. The combination of claim 8 wherein said concrete structure includes abutting slabs between which the expansion joint is formed.

12. The improvement as defined in claim 11 further including spacing means for ensuring that said other of the side surfaces of the insert is spaced throughout from the bonding interfaces.

13. In combination with a concrete structure having a load bearing surface, an expansion slot in said surface and a filler within said slot bonded to the concrete structure at interfaces between which the slot is formed, means for preventing spalling of the surface along intersections between the surface and the interfaces, including an insert embedded in the filler and extending through the slot from the load bearing surface and means for locationally restricting stress-induced fracture to the slot in spaced relation to said interfaces at which the concrete structure is bonded to the filler.

14. The combination of claim 13 wherein said insert has opposite side surfaces spaced from the interfaces and means enhancing the bonding of the filler to one of the opposite side surfaces for directing said restricted stress-induced fracture along the other of the side surfaces.

15. A method of preventing spalling of a concrete surface at edges of concrete bonding interfaces defining joint spaces occupied by fillers having a tensile strength resisting formation therein of stress-induced cracks, the steps of: placing inserts into said joint spaces extending through the fillers from the concrete surface; spacing opposite sides of the inserts throughout from the concrete bonding interfaces within the joint spaces; and directing said formation of the stress-induced cracks through the joint spaces along one of the sides of each of the inserts in spaced relation to the bonding interfaces.

16. In combination with a concrete structure having a surface subjected to repeated impact loads under long term stress-induced fracture conditions, and a joint installed therein which includes a joint space formed in the concrete structure intersecting the surface at spaced edges and an impact-resistant filler completely occupying said joint space to protect said edges from exposure to the impact loads, said filler being bonded to the concrete structure with a predetermined adhesive strength and, means embedded in the filler for locationally restricting stress-induced fracture of the concrete structure to the joint space in spaced relation to the edges to maintain said protection thereof by the filler.

17. The combination of claim 16 wherein the filler embedded means is an insert strip having opposite sides extending from the surface bonded to the filler with less than said predetermined adhesive strength.

18. The combination of claim 17 including means for enhancing the bonding of one of said sides of the insert strip to the filler to limit said stress-induced fracture to the other of the sides of the insert.

* * * * *